United States Patent [19]

Pearcey et al.

[11] 4,352,260

[45] Oct. 5, 1982

[54] UNDERGROUND HOUSE AND CONSTRUCTION METHOD

[76] Inventors: Leroy G. Pearcey, 333 W. Dunlap, #236, Phoenix, Ariz. 85021; Dale A. Pearcey, 3730 S. Mill Ave., #E106, Tempe, Ariz. 85282

[21] Appl. No.: 130,559

[22] Filed: Mar. 14, 1980

[51] Int. Cl.[3] ..... E04B 1/32; E04B 7/08

[52] U.S. Cl. ..... 52/80; 52/169.6

[58] Field of Search ..... 52/80, 81, 169.6, 2; 135/1 C, 3 B, 3 R

[56] References Cited

U.S. PATENT DOCUMENTS

| | | | |
|---|---|---|---|
| 744,199 | 11/1903 | Hubbell | 52/80 |
| 2,365,145 | 12/1944 | Neff | 52/80 |
| 3,176,698 | 3/1965 | Warner | 135/1 C |
| 4,022,644 | 5/1977 | Smith | 52/80 |
| 4,069,832 | 1/1978 | Bingham | 135/3 R |
| 4,143,502 | 3/1979 | Wyche | 52/80 |
| 4,144,680 | 3/1979 | Kelly | 52/80 |
| 4,155,967 | 5/1979 | South | 52/80 |

*Primary Examiner*—Reinaldo P. Machado
*Attorney, Agent, or Firm*—Cahill, Sutton & Thomas

[57] ABSTRACT

An underground house includes a dome-shaped structure disposed on a solid floor slab. A plurality of curved arch members extend from the floor slab to a ring structure. A layer of stiff mesh supporting a layer of fabric extends between each arch member and the arch members adjacent thereto. Alternate layers of spaced horizontal and vertical reinforcing rod extend over and generally parallel to the fabric and are supported by the various arch members. The various pieces of reinforcing rod are tied together and to the adjacent mesh by pieces of tie wire to support the mesh and the fabric. The fabric provides support during construction for a layer of gunnite or shotcrete into which various pieces of the reinforcing rod are embedded. Front and rear atriums with vertical, semi-cylindrical walls extend to the lower floor level. The atrium walls extend to adjoin the layer of gunnite to laterally enclose the atriums. Openings in the wall of the dome-shaped structure allow light in the atriums to enter the dome-shaped structure. A windowed cover is disposed over the ring structure to allow outside light to enter the dome. Earthen material covers the dome structure up to the base of the dome except portions bounded by the atrium walls, entry way cowls, and the windowed cover.

13 Claims, 11 Drawing Figures

UNDERGROUND HOUSE AND CONSTRUCTION METHOD

BACKGROUND OF THE INVENTION

1. Field of the Invention

The invention relates to underground houses and methods of construction thereof and, more particularly, to dome-shaped underground houses and methods of construction thereof.

2. Description of the Prior Art

With the advent of rapidly rising housing construction costs and heating and cooling costs, many different types of low-cost energy-efficient dwelling structures have been proposed. Underground or partially underground dwelling structures which have been proposed have certain advantages, a major advantage being that the temperature of the earth becomes more nearly constant as depth of the dwelling structure increases. Consequently, relatively uniform temperatures both in summer and winter have been obtained with previous underground or partially underground dwellings. However, in the past, it has been difficult and expensive to attain satisfactory lighting of the interior of known underground structures. Further, the costs of construction frequently have been unacceptably high compared to other low cost above-ground (but less energy efficient) dwelling structures.

Accordingly, it is an object of the invention to provide a low cost, energy-efficient dwelling structure and method of construction thereof providing substantially more natural interior lighting than has been available from previous underground or partially underground dwelling structures.

A variety of above-ground dome-shaped building structures have been proposed. However, they have required complex and unduly expensive welded steel frames. Expensive siding materials have been attached to the steel frames. Due to their high cost and the absence of any advantages related to energy efficiency, above-ground dome-shaped residential structures have not been popular.

It is another object of the invention to provide a dome-shaped structure having sufficient structural strength to support surrounding earth and earth which lies against the structure without requiring complex and unduly expensive supporting structure.

Previously, dome-shaped structures having exterior concrete or gunnite surfaces were required to be constructed by utilizing preformed dome-shaped forms or support structures to prevent sagging of the moist concrete walls prior to hardening thereof. The necessity for providing such forms added greatly to the difficulty and expense of making prior dome-shaped building structures.

Accordingly, it is still another object of the invention to provide a method of making a dome-shaped building structure without the necessity of providing expensive forms to support its concrete wall when it is moist.

SUMMARY OF THE INVENTION

Briefly described, and in accordance with one embodiment thereof, the invention provides a dome-shaped structure suitable for residential purposes and a method of constructing the dome-shaped structure. The described basic dome-shaped structure includes a generally circular or oval concrete floor having a plurality of spaced peripheral floor brackets attached thereto and tubes for receiving lower ends of reinforcement rods embedded therein. The structure also includes an upper ring structure having a plurality of top brackets attached thereto. A plurality of semicircular arch members each have lower and upper ends which are received by the floor brackets and the top brackets, respectively. The end of each arch member are bolted to the appropriate floor plate or ring bracket. In the described embodiment of the invention, panels including a supporting layer of stiff wire mesh and a layer of burlap fabric supported by the mesh are disposed between sections of the dome-shaped structure, each section being a region between two adjacent arch members. A first layer of horizontal reinforcing metal rods is positioned over the mesh and fabric panels. A second layer of vertical reinforcing rods is positioned over the first layer of horizontal rebar, the lower ends of the vertical reinforcing rods being inserted into the tubes embedded in the periphery of the concrete floor. A third layer of horizontal reinforcing rods is positioned over the vertical layer thereof. At crossover points of the various reinforcing rods, tie wires are utilized to tie the various pieces of reinforcing rod and the mesh layer together. Two atriums which extend to the level of the concrete slab have floors which are continguous with the concrete floor of the dome-shaped section. Vertical atrium walls which extend above the earth level are provided either by conventional masonry techniques or by providing a mesh, fabric, and reinforcing bar structure similar to that utilized for the dome-shaped structure. Upper portions of one of the atrium walls serve as side walls for a front walkway of the structure. The walkway extends partially over the front atrium to a front door of the dome-shaped structure. The outer wall of the dome-shaped structure is produced by spraying a layer of cementitious material, such as gunnite or "shotcrete", over the exposed fabric. The cementitious material surrounds the reinforcing rods, which become embedded in the cementitious material when it hardens. Subsequently, an interior layer of gunnite or shotcrete is sprayed over the entire interior surface of the dome to provide an interior wall and ceiling surface. A roofed pentagon structure is disposed above the connecting ring at the peak of the dome-shaped structure. A plurality of windows are provided in the pentagon structure to provide adequate natural lighting of the upper level of the dome-shaped structure. Openings into the atriums are provided in the outer wall of the lower level of the dome-shaped structure to admit outside light therein; sliding glass doors are utilized to provide entry into the atriums from the lower level of the dome-shaped structure. A central ring supports inner ends of a plurality of radially disposed horizontal beams which extend to and are attached to a plurality of the arch members to support the floor of the upper level. Earthen material removed during excavation of the hole in which the dome-shaped structure is constructed is moved to cover the outer wall of the dome-shaped structure. Vertical atrium walls prevent earthen material from entering the atriums. Side walls extending from the outer wall on both sides of a front door of the dome-shaped structure are provided to prevent earthen material from falling into the entry way. In the described embodiment of the invention, the main entrance includes a walkway which extends over and partially covers the front atrium of the structure. An overhead deck with peripheral decorative railing serves as a roof which keeps rain out of the front atrium and as a recreational area which can be entered by walking up the sloped earthen material which covers the upper portion of the dome-shaped structure. The rear atrium is uncovered. A rear deck with side walls protects a rear entry into the back yard behind the dome-shaped structure.

DESCRIPTION OF THE INVENTION

Figure 1:
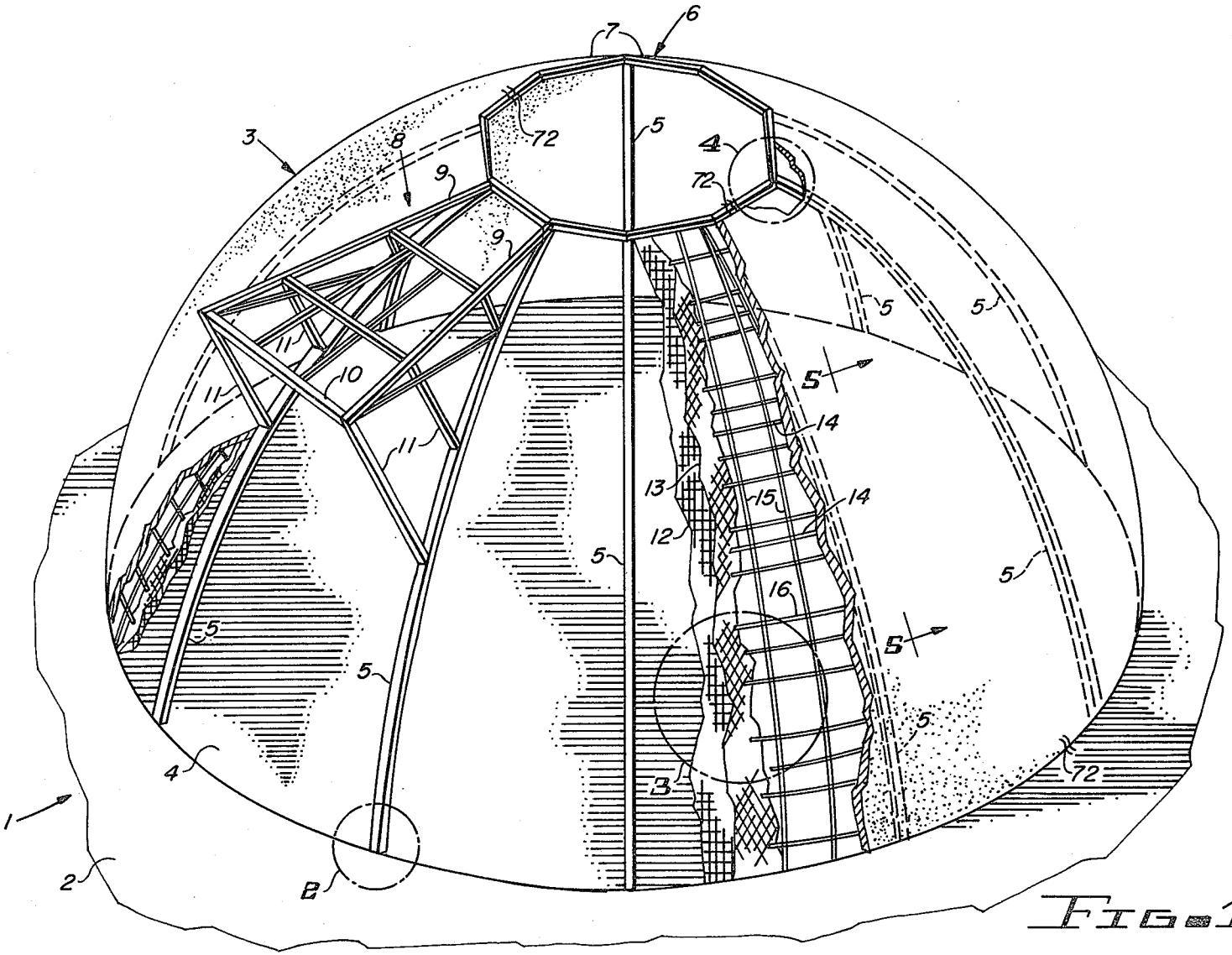
FIG. 1 is a partial cutaway perspective view of the dome structure of the present invention.

The basic structure of the dome portion of the underground dwelling structure of the present invention can best be understood with reference to FIGS. 1–5. (It should be noted that the term "underground" as used herein and in the claims refers to structures which are only partially located beneath the surface of the earth or are partially covered with earthen material.) In FIG. 1, the underground residence 1 is shown disposed upon an underground floor surface 2 which has been excavated to a depth of roughly 8 to 10 feet beneath the surrounding ground level. A poured concrete floor slab 4 supports the dome walls of dome structure 3. In the illustrated embodiment of the invention, dome structure 3 includes ten semicircular arch members 5 which support the outer walls, subsequently described. Each of arch members 5 is essentially a semicircular I-beam, the lower end of which is rigidly attached to a peripheral portion of circular concrete floor 4. (It should be noted that although a generally hemispherical dome-shaped embodiment of the invention having a circular floor is described herein, an oval or oblong dome-shaped structure also can be provided using the techniques and structure described herein. Reference numeral 72 of FIG. 1 indicates break lines along which the floor and wall structure could be elongated to provide such an oblong configuration.) The upper end of each of arch members 5 is connected to a decagon ring 6, which is formed of steel.

The manner of connecting the lower end of each arch member (hereinafter referred to as arch beam 5) to concrete floor 4 is shown in more detail in FIG. 2 wherein it is seen that concrete floor 4 has a deepened foundation portion 18 extending along the peripheral boundary of concrete floor slab 4. A pair of floor brackets 22 are spaced from each other by an amount sufficient to accommodate the web of the lower I-beam structure of arch beam 5. Floor brackets 22 are bolted into concrete floor 4 by means of bolts 23. Each of floor brackets 22 has a pair of holes 28 in the vertical portion thereof. When the lower end of arch beam 5 is inserted into the space between floor plates 22, holes 19 in the web of arch beam 5 are aligned with holes 28 in floor brackets 22. Bolts 20 and nuts 21 are deployed to permanently and rigidly attach arch beam 5 to floor brackets 22. All of the arch beams 5 are attached to floor 4 in this manner.

Figure 4:
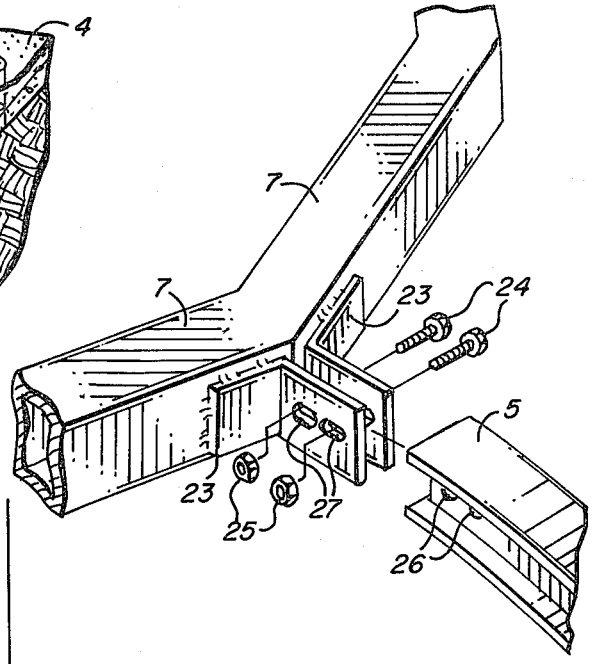
FIG. 4 is an enlarged perspective view of detail 4 of FIG. 1.

The details of attachment of the upper end of each of arch beams 5 to decagon ring 6 are shown in FIG. 4, which is an enlarged view of detail 4 of FIG. 1.

Referring to FIG. 4, a pair of spaced angle brackets 23 are welded to the outside surface of adjacent straight sections constituting decagon ring 6. Each of brackets 23 has a pair of elongated holes 27 therein. The two outer plates of each of brackets 23 are parallel and are spaced apart by sufficient distance to accommodate the web member of arch beam 5, which has a pair of holes 26 which are aligned with holes 27 when the web member of arch beam 5 is slid as far as possible into the space between brackets 23. Bolts and nuts 24 and 25 are then tightened to rigidly connect the upper end of each of arch beams 5 to appropriate connecting brackets of decagon ring 6.

A front deck support structure 8 is attached between two of arch beams 5, as shown in FIG. 1. Deck support structure 8 includes two horizontal metal beams 9 extending horizontally outward from one of the decagon ring members 7. Each of horizontal members 9 are supported by a plurality of vertical or semi-vertical support members 11, which are supported as shown by respective ones of arch beams 5. A second rear deck support for supporting the rear deck 40 is omitted from the drawing in FIG. 1 for convenience. Suitable cross members between parallel horizontal beams 9 are attached thereto to provide a suitable support for front deck 38, shown in FIG. 6.

The wall structure of dome 3 is best explained with reference to FIGS. 1, 3 and 5. On the interior side of the wall structure, but on the outer side of arch beams 5, a layer of stiff or semi-rigid wire mesh 12 supports a layer of fabric 13, such as burlap. The mesh can be steel mesh of a type referred to as "6-6-10-10 steel mesh" in the trade. A "layer" of spaced horizontal rebar members 14 are disposed at approximately one foot centers. A plurality of vertical rebar sections 15 are also spaced at approximately one foot centers at the base of dome structure 3. The vertical rebar members 15 have lower ends which fit into tubes 71, which are embedded in concrete 4, as shown in FIG. 2.

Figure 2:
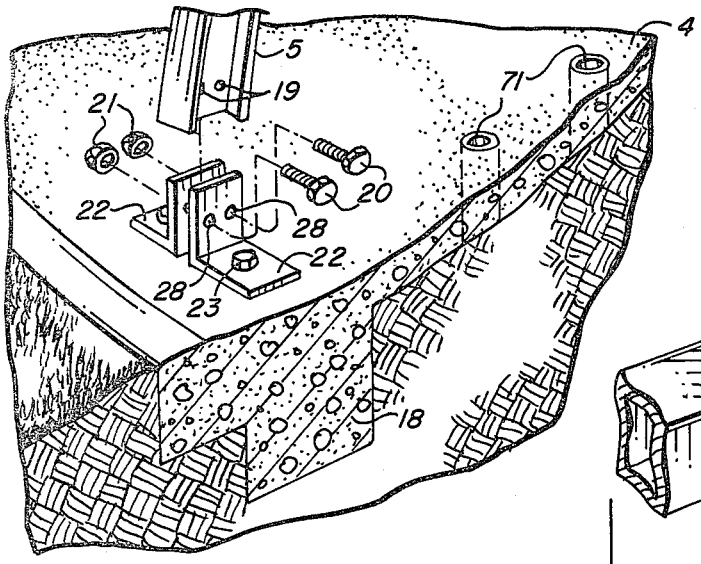
FIG. 2 is an enlarged perspective view of detail 2 of FIG. 1.

A third layer of rebar includes vertical spaced members 15, the lower ends of which have been inserted in rebar receiving tubes 71 of FIG. 2. A third layer of rebar pieces includes horizontal pieces 16, spaced at two foot centers. The horizontal pieces of rebar are either tied to the outer surfaces of the arch beams, or are secured by means of holding tabs (not shown) which may be provided on the outer surfaces of the arch beams.

Figure 3:
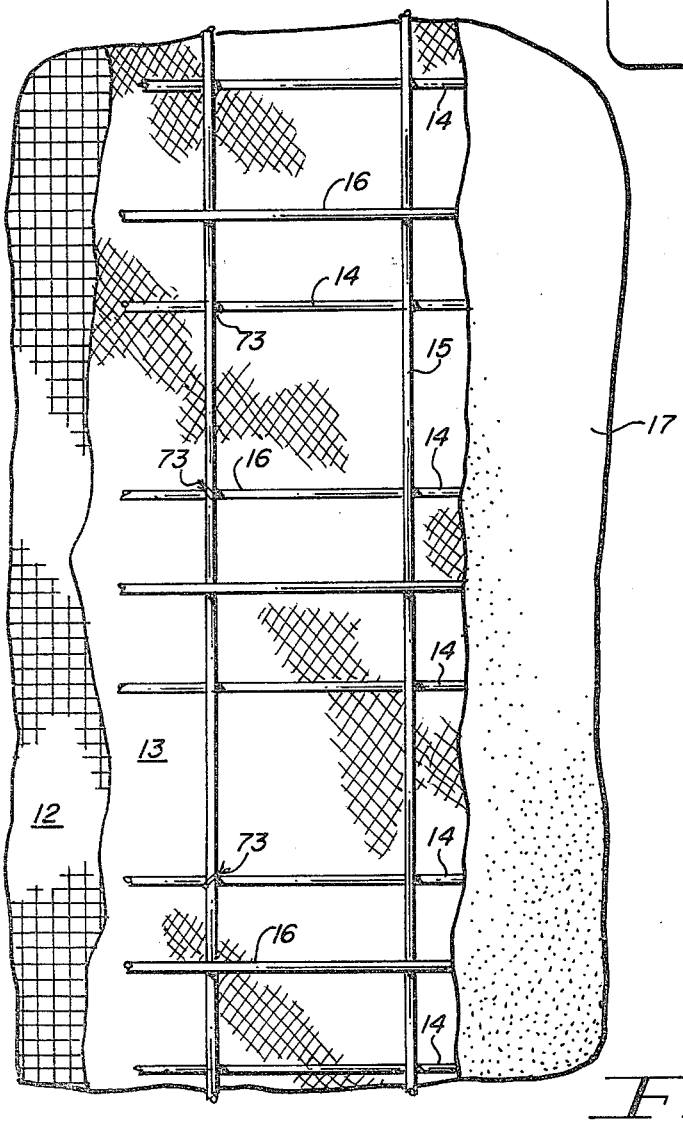
FIG. 3 is an enlarged plan view of detail 3 of FIG. 1.

As seen in FIG. 3, wire ties 73 are utilized at all of the various intersections of rebar pieces 14, 15 and 16 to tie the various sections of rebar and the underlying mesh and burlap together, thereby effecting substantial support for the burlap layer when moist gunnite is later sprayed thereon. In some cases, it is desirable to initially provide a number of ties to tie only certain rebar pieces together without engaging the mesh/fabric layer in order to conveniently effect proper initial positioning of the various horizontal and vertical pieces of rebard.

Figure 5:
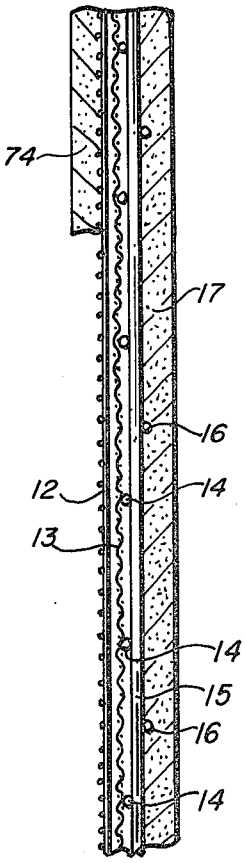
FIG. 5 is a section view taken along section line 5—5 of FIG. 1.

After all of the above mentioned sections of rebar and mesh/fabric are tied together, gunnite or a moist substance known in the trade as "shotcrete" is sprayed on the outer surface to provide an outer gunnite layer 17, as shown in the cross-sectional view of FIG. 5. Later, a layer of gunnite 74 is sprayed on the interior surface of the structure to provide an interior wall which can be finished having a pleasing plaster-like appearance. The thickness of the interior gunnite layer 74 is approximately several inches. The thickness of the composite outer wall layer, including the mesh 12, the burlap fabric 13, and the three layers of rebar is approximately four inches. The sprayed on gunnite or shotcrete completely surrounds the two outer layers of rebard, reinforcing the gunnite.

The rippled surface of burlap fabric 12 in FIG. 5 as it stretches between the mesh wires of mesh 13 due to the weight of the moist gunnite layer, provides a rough, uneven surface to which the sprayed on interior gunnite layer 74 can securely and safely adhere.

Other structural features of the underground dome-like dwelling structure can be best explained with reference to FIGS. 6–10. One important feature is that the dome-like structure 3 has an upper level with a floor 52 and a lower level with floor 4. Brackets for receiving the outer ends of the radial wood beams 52' which support second level floor 52 are bolted to or preattached to the inner surfaces of appropriate ones of arch beams 5. The inner ends of the radial wood beams are supported by center support 47.

Figure 9:
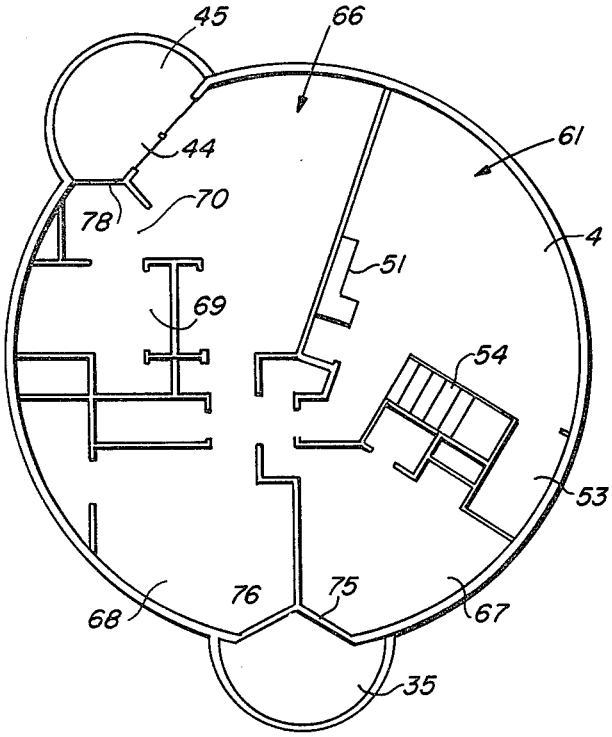
FIG. 9 is the lower level plan view of the dome-shaped structure of FIGS. 1–8.
Figure 10:
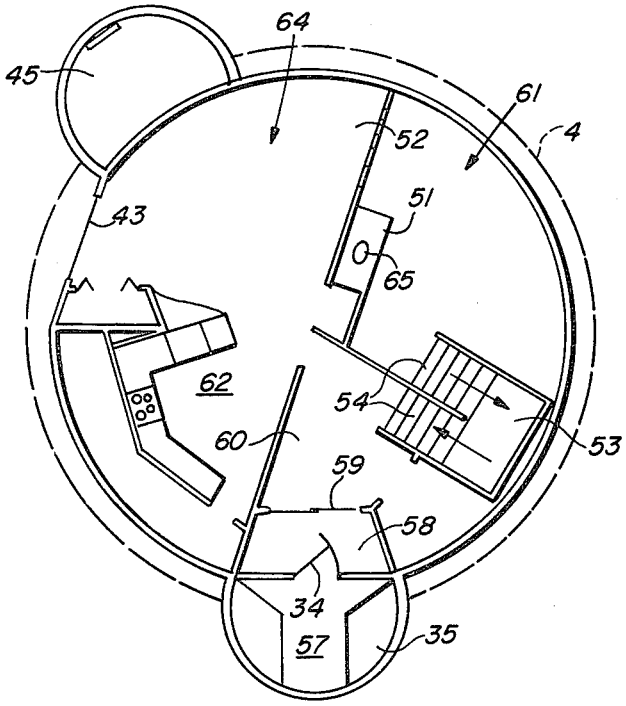
FIG. 10 is an upper level floor plan of the dome-shaped dwelling structure of FIGS. 1–8.

A roofed pentagon structure 31 (through which a chimney 50 for fireplace 51 located on a lower level extends) has a plurality of side windows 37. Light admitted through windows 37 passes through decagon ring 6 and provides ample daylight for the entire upper level. The lower level floor plan and the upper level floor plan are shown in FIGS. 9 and 10, respectively. Referring to FIG. 9, the lower level includes a living room 61, the ceiling of which is formed by the interior wall of dome structure 3. As is seen in FIG. 10, the upper level floor does not extend over living room area 61. Referring again to FIG. 9, it is seen that two atriums, namely front atrium 35 and rear atrium 45 provide ample natural lighting to master bedroom 66 and room 70. A pair of sliding glass doors 44 provide access from master bedroom 66 into atrium 45. Bedrooms 67 and 68 have windows 75 and 76, respectively, which permit ample entry of outside light into bedrooms 67 and 68.

Referring now to FIG. 10, the upper level includes a walkway 57 which partially covers atrium 85 and a front entrance door 34. A closed region 58 is optionally provided to decrease loss of heat or cold from the interior of underground residence 1 during entry or exit therefrom through door 34. A sliding glass door 59 provides access from enclosed region 58 into foyer 60. A person standing in the foyer can then enter the kitchen area 62 or dining area 64 of the upper level through door opening 77, or can go downstairs into the living room or bedroom areas by means of stairs 54 and landing 53.

A rear exit 43 from dining area 64 is provided by means of sliding glass doors 43 into the back yard.

Figure 6:
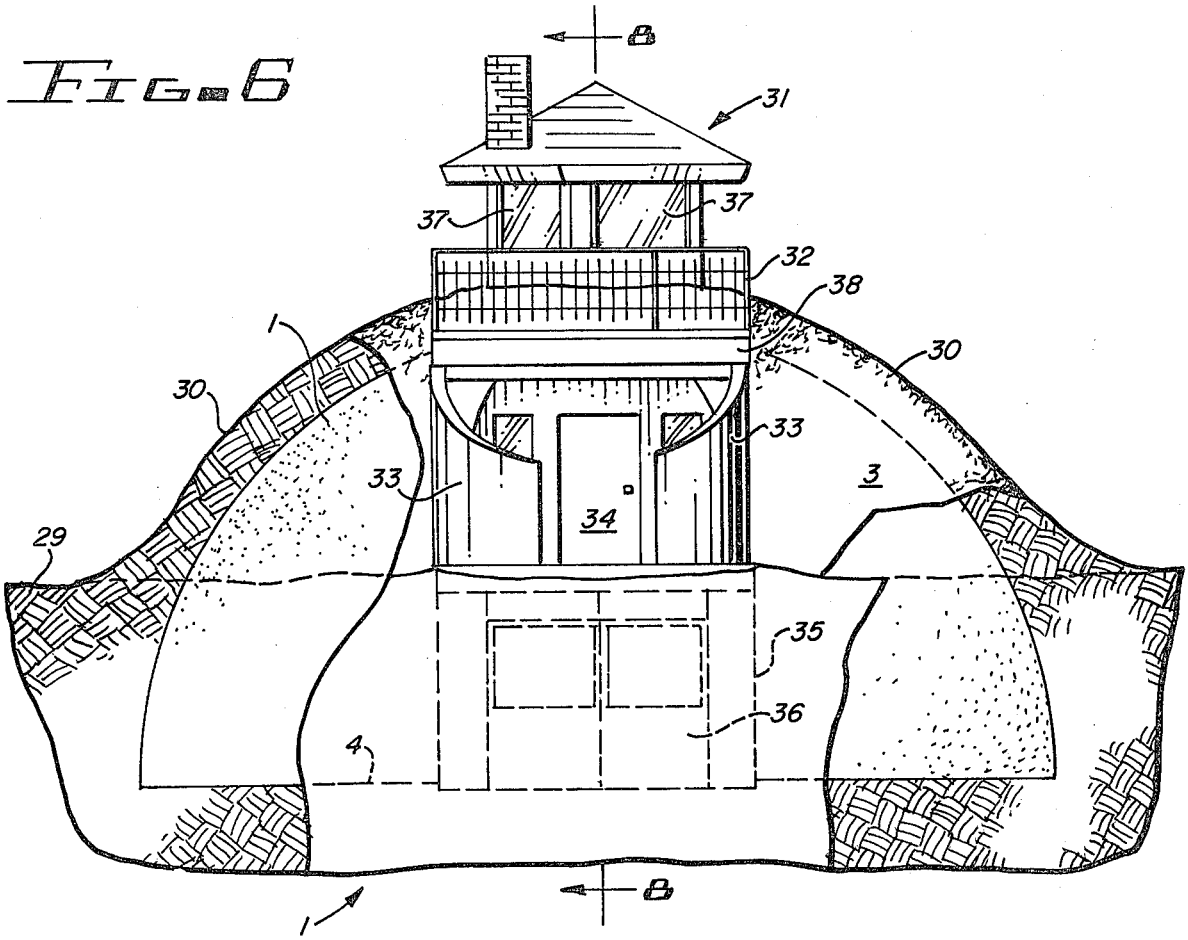
FIG. 6 is a partial cutaway front elevational view of the under earth dwelling structure of the present invention.
Figure 8A:
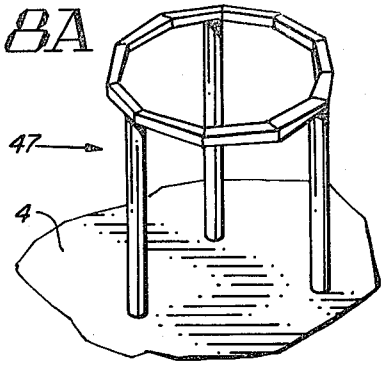
FIG. 8A is a partial perspective view of the center second floor support structure shown in FIG. 8.
Figure 8:
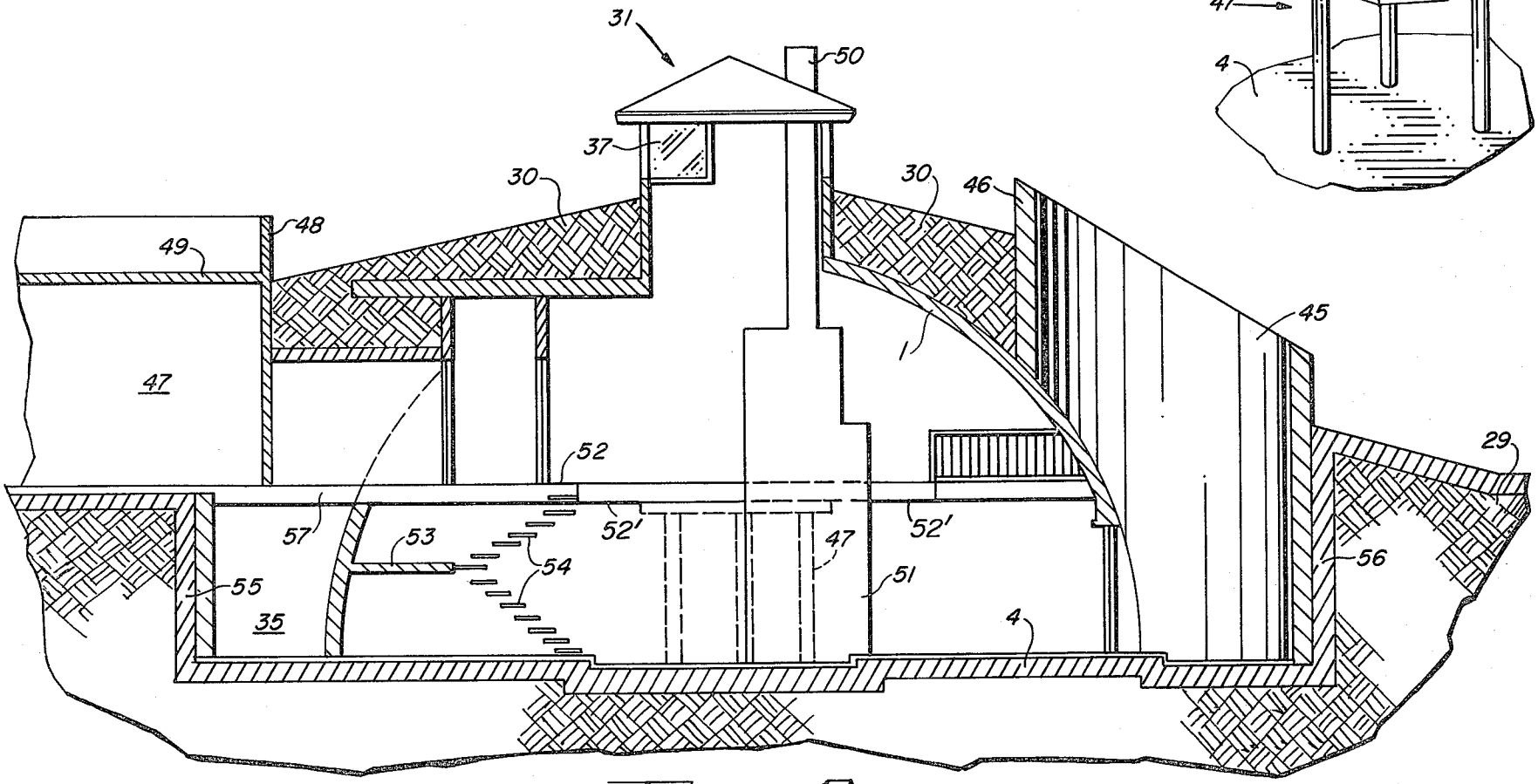
FIG. 8 is a partial modified sectional view of the dome-shaped under earth dwelling structure of FIGS. 1–7.

As shown in FIG. 8, which is a sectional view taken through the center of FIG. 6 along section line 8—8, earthen material is "bermed up" to cover the entire exposed outer surface of dome structure 3 to a depth of at least several feet. This earthen cover provides great insulating and heat storage capabilities which maintain the temperature in underground residential building 1 substantially cooler in summer, warmer in winter, and generally more uniform than would be the case for a conventional above-ground dwelling structure.

Rear atrium 45 is partly surrounded by a large cylindrical wall structure against which the earthen material 40 rests, thereby preventing the earthen material from falling into rear atrium 45.

It should be noted that the sectional view of FIG. 8 is slightly modified to show sectional views of both front atrium 35 and rear atrium 45, which do not lie along a single diameter of the hemispherical dome-like structure, as is readily apparent in FIGS. 9 and 10.

An above-ground garage 47 is optionally provided on the left side of the dome-shaped underground structure as seen from the front thereof. The wall 48 of the garage structure extends above the roof 49 thereof, and includes an entry way (not shown) from the surface of the covering earth 30, enabling a person to utilize the roof 49 as a walled deck which can be entered into by walking up the earth covering 30 to the entry way.

Referring to FIG. 6, which is a front elevational partial cutaway view of underground residence 1, a pair of curved cutaway side wall or cowl members 33 extend from the outer surface of the dome-shaped structure 3. Cowl members 33 can be formed in the same manner as the wall of dome-shaped structure 3, utilizing mesh and fabric panels, rebar, and sprayed on gunnite covering both the inner and outer surfaces. The gap between the front edges of cowl members 33 forms an entry way through which a person can walk over walkway 57 to front door 34. A roof deck 38 rests on the horizontal members 39 of deck support 8 of FIG. 1. Rail 32 is provided mainly for decorative purposes, although deck 38 can be entered by a person who walks up the earthen cover 30 approximately to the base of penthouse 31.

The lower portion of front atrium 35, shown in dotted lines in FIG. 6, is accessible by means of sliding doors 36 from lower bedrooms 67 and 68.

It should be noted that for convenience the visible portion of rear deck 41 and rail 40 (FIG. 7) has been omitted from FIG. 6.

Figure 7:
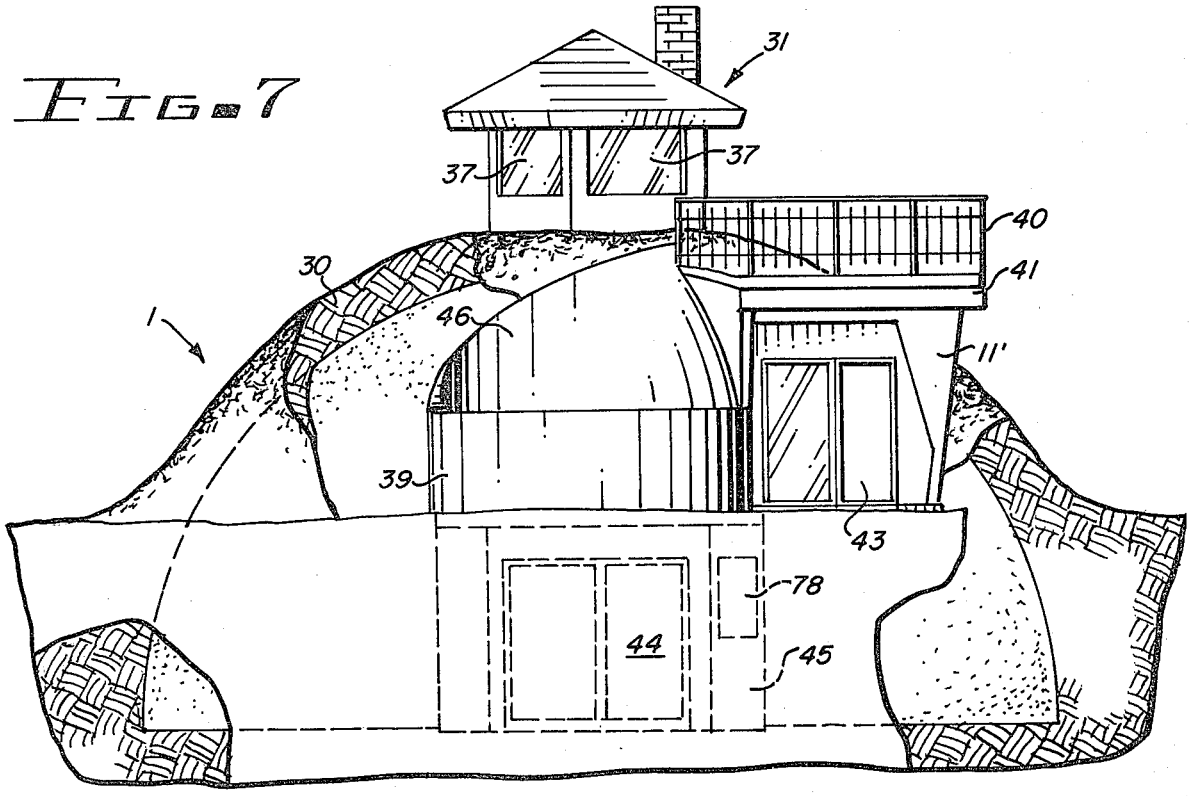
FIG. 7 is a partial cutaway rear elevational view of the under earth dome-shaped residential structure of the present invention.

Referring now to FIG. 7, a rear view of the underground residence 1 is shown, wherein the wall of closed atrium 45 extends substantially above the normal ground level. A portion 46 extends substantially above the remaining upper edge portion of the wall 39 of atrium 45 for decorative purposes. Door 43 provides an exit from the interior of underground structure 1 to the back yard thereof. A support structure 11' similar to support structure 8 of FIG. 1 supports rear deck 41. Decorative rear deck railing 40 is disposed along the periphery of rear deck 41. Sliding doors 44 provide access into rear atrium 45 from master bedroom 66. Window 78 provides outside lighting into room 70.

The foregoing underground dome structure has numerous advantages which make it suitable for construction by a "do-it-yourself" homebuilder. All of the elements shown in FIG. 1 for the basic dome structure 3 except the gunnite can be prefabricated and marketed in kit form. The curved I-beams from which arch beams 5 are constructed can be preformed and the end holes 19 and 26 can be predrilled. Decagon ring 7 can be prefabricated with the upper brackets 23 prewelded thereto. The lower floor brackets 22 can be readily provided in a kit, along with the rebar shown in FIG. 3. The mesh fabric layers can be made into single panels preformed to fit the sections between a pair of adjacent arch beams 5. The center support 47 of FIG. 8A, floor anchors therefore (not shown), and radial wood beams for supporting floor surface 52 can all be provided as part of a basic kit. Similarly, the members of which pentagon 31 is formed can also be prefabricated and sold as part of a kit. The interior floor plan is extremely versatile since there are no roof supporting interior walls. Thus, the interior walls can be placed anywhere they are desired. Similarly, the atriums can be placed wherever they are desired to provide adequate interior light in the lower level. Three or more atriums could be utilized, if desired.

The first step in the construction process will ordinarily be to excavate the building site of the underground residence to a depth of eight to ten feet. Ordinarily, the hole should extend at least five or six feet beyond the desired boundary of the floor (including the atrium floors) of the intended structure. All of the required plumbing for the lower level and duct work for air conditioning, if desired, is positioned in the floor site before the circular or oval concrete floor 4 is poured therein. The rebar receiving tubes 71 are embedded in the moist floor concrete or else are prepositioned before the floor concrete is poured. Rebar receiving tubes 71 greatly facilitate positioning of the vertical rebar rods 15.

The earthen material removed during excavation of the hole in which the floor structure is poured is simply pushed aside, as later it is pushed back into the excavated hole against the concrete outer surface of the dome, and is used to provide the upper earthen covering 30 shown in FIGS. 6–8.

After the floor concrete is poured, and while it is still moist, the floor brackets 22 of FIG. 2 are positioned and bolted into the concrete by means of bolts 23. At the same time, brackets for center support 47 of FIG. 8A can be centrally positioned and bolted into the concrete floor.

After the floor concrete has hardened, a crane or other support is provided to centrally position decagon ring 6 above floor 4. Several workers, preferably three, position each of the arch beams 5 by dropping its lower end into the space between a pair of floor brackets 22 and placing its upper end between a pair of upper brackets 23 attached to decagon ring 6 and bolting the upper ends of the arch beam to the decagon ring and floor slab, respectively. After attachment of the deck support 8 (the details of which attachment are not shown because they could be readily provided by those skilled in the art), and after determining the location of the two atriums, vertical atrium walls can be built of cement block if desired, instead of using the above described composite mesh/fabric/rebar structure previously described.

The technique for making the outer wall of dome-shaped structure 3 includes the following steps. First, the respective panels of mesh and burlap or other suitable fabric are disposed between and supported by each adjacent pair of arch beams. Note that the mesh and fabric can be precut into suitably sized panels and pre-tied together to make easily manipulated composite panels which are easily installed. The lower layer 14 of horizontal rebar pieces is then positioned, each piece extending between the various arch beams and attached thereto by means of tie wire or preformed bendable brackets (not shown) attached to the respective arch beams. Next, the lower ends of vertical rebar rods 15 are all inserted into the respective rebar receiving slots 71 and are bent to lie against the underlying horizontal layer of rebar members 14. The outer rebar layer rods 16 are then positioned over the vertical rebar rods 15, and at each intersection of two or more pieces of rebar, those rebar rods and the underlying mesh and fabric are tied together by means of tie wire pieces 73. The various pieces of rebar are bent or flexed slightly during the above positioning steps so that the rebar pieces are curved in correspondence with the slope of dome-shaped structure 3. It should be noted that the above described method of installing the mesh, fabric, and rebar is merely exemplary. Another suitable approach would be to first install the vertical rebar rods, then position the inner layer of horizontal rebar rods behind the vertical rebar rods, and then position the outer layer of horizontal rebar rods on the outer side of the vertical rebar rods. Then the above mentioned composite panels of fabric and rebar can be positioned behind (i.e., on the inner side of) and tied to the rebar layers.

Suitable framework for the front and rear atrium walls and the cowls 33 (FIG. 6) can be similarly formed to provide a foundation for spraying gunnite thereon.

The next step is to spray approximately 4 inches of gunnite or "shotcrete" onto the mesh/fabric layer, whereby the various layers of rebar become embedded in and reinforce the gunnite layer 17 when it hardens.

Before the gunnite layer 17 is sprayed onto the dome shaped structure 3, supports must be provided at approximately four equally spaced locations of each section (between adjacent arch beams such as 5) to prevent slight sagging of the rebar, mesh and fabric as the heavy gunnite or shotcrete is sprayed thereon. This can easily be accomplished by providing four T-shaped supports of various lengths which are wedged between the floor 4 and the inner surface of the mesh/fabric to support it at the four spaced points before spraying of the gunnite onto the exterior surface thereof.

Next, the radial beams on which the second floor 52 is supported are installed by resting their inner ends on the ring of center support 77 and bolting their outer ends to braces attached to the midpoints of arch beams 5.

Pentagon 31 can be installed and assembled without utilizing any special techniques, its structure and assembling method therefore are not described in detail. Remaining details of the construction of underground residence, including pushing the earthen material 30 over the exposed gunnite outer wall surface, spraying interior gunnite layer 74 of the interior wall surfaces of the dome-shaped shell, installing satisfactory interior stud and wall materials and the like can be readily done by those skilled in the art and therefore are not described herein in further detail.

While the invention has been described with reference to a particular embodiment thereof, those skilled in the art will be able to provide variations in the disclosed structure and method without departing from the true spirit and scope of the invention. For example, an above ground retaining wall can be built around the periphery of the "bermed up" portion of the dome to retain the earthen material covering the dome surface and to provide an attractive exterior appearance. An attractive above-ground garage may be built adjacent or contiguous to the the dome or retaining wall. Other materials, such as synthetic fabrics, can be used instead of the fabric described.

We claim:

1. An underground residential structure comprising:
a. a solid floor slab;
b. a generally dome-shaped outer wall;
c. a plurality of curved arch members for supporting said outer wall, each arch member having an upper end and a lower end;
d. lower attaching means for rigidly attaching the lower ends of said arch members to peripheral portions of said floor slab;
e. upper attaching means for rigid attachment to the upper ends of said arch members to hold said plurality of arch members in a dome-like configuration over said floor slab;
said outer wall including
i. an inner layer of semi-rigid mesh,
ii. a layer of fabric supported by said mesh,
iii. a plurality of reinforcing rods disposed adjacent to the outer surface of said fabric, at least some of said reinforcing rods being supported by various ones of said arch members,
iv. connecting means for connecting a plurality of points of said mesh to various ones of said reinforcing rods to support said mesh and said fabric,
v. a layer of solid cementitious material disposed on said fabric, said cementitious material covering said reinforcing rods and embedding a plurality of said reinforcing rods in said cementitious material,
f. a roofed structure disposed over said upper attaching means, said upper attaching means being substantially ring-shaped and having a sufficiently large opening to admit a substantial amount of outside light into said underground residential structure, said roofed structure having window means for allowing said outside light to reach said opening in said upper attaching means;
g. an upper floor disposed above said floor slab, said floor slab being disposed substantially lower than the earth surface generally surrounding said residential structure, an upper portion of said outer wall being above said earth surface, a layer of earthen material being disposed on a major portion of said outer wall to cover said major portion, said major portion extending to said roofed structure; and
h. a first atrium, said first atrium having a substantially vertical wall, earthen material abutting a lower portion of the outer surface of said vertical wall, an upper portion of said vertical wall extending above the abutting earthen material to prevent entry of any of the abutting earthen material into said first atrium, said vertical wall adjoining said outer wall having a first opening therein for admitting outside light from said first atrium into said residential structure.

2. The underground residential structure of claim 1 wherein said outer wall has a door for allowing entry into an upper level of said residential structure, a platform extending over only a portion of said first atrium to provide a walkway over said first atrium to said door.

3. The underground residential structure of claim 2 including a cover structure disposed over said door and said first atrium, said cover structure extending outward from said outer wall above said door, upper portions of said vertical wall of said first atrium extending above said earth surface to form side walls extending from said outer wall on either side of said walkway.

4. The underground residential structure of claim 2 wherein said upper floor is supported by a plurality of horizontal beams each extending approximately radially from a center region of said upper floor to various ones of said arch beams, the inner end portions of said horizontal beams being supported by a ring structure, said ring structure having a plurality of vertical supports resting on said floor slab.

5. The underground residential structure of claim 1 wherein:
said floor slab is composed of concrete;
each of said arch members is composed of steel and has an I-beam cross-section, each end of each arch member having a hole in the web of the I-beam cross-section thereof;
said lower attaching means includes a plurality of pairs of right angle brackets attached to said floor slab, the right angle brackets of each pair being spaced to receive the web of the lower end of one of said arch members, the right angle brackets of each pair each having a hole which is aligned with the hole in the web of the lower end of that arch member to effect bolting of that arch member to that pair of right angle brackets; and
said ring-shaped connecting means having a plurality of pairs of angle brackets attached thereto for receiving webs of the upper ends of respective ones of said arch members, each of said angle brackets having a hole therein which is aligned with the hole in the web of the upper end of a respective one of said arch beams to effect bolting of that arch beam to said ring-shaped connecting means.

6. The underground residential structure of claim 1 wherein said cementitious material is composed of gunnite.

7. The underground residential structure of claim 1 wherein said cementitious material is composed of shotcrete.

8. The underground residential structure of claim 1 wherein said reinforcing rod is rebar.

9. The underground residential structure of claim 1 wherein said fabric is burlap.

10. An underground structure comprising:
a solid floor slab disposed in a hole having a bottom substantially lower than the earth level generally surrounding said underground structure;
a dome-like structure covering and supported by said floor slab, said dome-like structure having an outer wall, said outer wall having a first opening therethrough located near the top center portion of said dome-like structure, said outer wall having a second opening therethrough located closer to a base of said dome-like structure than to said first opening, said top center portion of said dome being substantially above said earth level, earthen material covering a substantial portion of said outer wall;
an atrium contiguous with said dome-like structure, said atrium having an open top allowing outside light to enter said atrium, said atrium having a substantially vertical wall laterally enclosing said atrium, said substantially vertical wall adjoining said outer wall, said outer wall and said substantially vertical wall completely laterally enclosing said atrium, said second opening in said outer wall allowing light in said atrium to enter said dome-like structure, some of the earthen material lying against said vertical wall; and a windowed protective structure covering said first opening to allow outside light to enter said dome-like structure through said first opening and to prevent rain and air from passing through said first opening.

11. An underground structure comprising:

a foundation disposed in a hole having a bottom substantially lower than the earth level generally surrounding said underground structure;

a dome-like structure covering and supported by said foundation, said dome-like structure having an outer wall, said outer wall having a first opening therethrough located near the top center portion of said dome-like structure, said outer wall having a second opening therethrough located closer to a base of said dome-like structure than to said first opening, said top center portion of said dome being substantially above said earth level, earthen material covering a substantial portion of said outer wall;

an atrium contiguous with said dome-like structure, said atrium having an upper light-admitting portion for allowing outside light to enter said atrium, said atrium having a substantially vertical wall laterally enclosing said atrium, said substantially vertical wall adjoining said outer wall, said outer wall and said substantially vertical wall completely laterally enclosing said atrium, said second opening in said outer wall allowing light in said atrium to enter said dome-like structure, some of the earthen material laying against said vertical wall; and a windowed protective structure covering said first opening to allow outside light to enter said dome-like structure through said first opening and to prevent rain and air from passing through said first opening.

12. The underground structure of claim 11 wherein said dome-like structure is substantially oblong.

13. An underground structure comprising:

a foundation disposed in a hole having a bottom substantially lower than the earth level generally surrounding said underground structure;

a dome-like structure covering and supported by said foundation, said dome-like structure having an outer wall, said outer wall having a first opening therethrough located near the top center portion of said dome-like structure, said outer wall having a second opening therethrough located closer to a base of said dome-like structure than to said first opening, said top center portion of said dome being substantially above said earth level, earthen material covering a substantial portion of said outer wall; and an atrium contiguous with said dome-like structure, said atrium having an upper light admitting portion for allowing outside light to enter said atrium, said atrium having a substantially vertical wall laterally enclosing said atrium, said substantially vertical wall adjoining said outer wall, said outer wall and said substantially vertical wall completely laterally enclosing said atrium, said second opening in said outer wall allowing light in said atrium to enter said dome-like structure, some of the earthen material lying against said vertical wall.

* * * * *